US006295434B1

(12) United States Patent
Chang et al.

(10) Patent No.: US 6,295,434 B1
(45) **Date of Patent: *Sep. 25, 2001**

(54) POROUS TRANSFER MEMBERS AND RELEASE AGENT ASSOCIATED THEREWITH

(75) Inventors: Shu Chang, Pittsford; Edward L. Schlueter, Jr., Rochester; Laurence J. Lynd, Macedon, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/315,289

(22) Filed: May 20, 1999

(51) Int. Cl.[7] ..... G03G 15/16

(52) U.S. Cl. ..... 399/297; 399/303; 399/312; 399/313

(58) Field of Search ..... 399/297, 121, 399/176, 313, 314; 524/806, 837; 428/195

(56) References Cited

U.S. PATENT DOCUMENTS

| | | | | |
|---|---|---|---|---|
| 4,743,939 | * | 5/1988 | Dulmage et al. | 399/311 |
| 5,035,926 | | 7/1991 | Jonas et al. | 427/393.1 |
| 5,214,095 | * | 5/1993 | Lavoie | 524/806 |
| 5,303,014 | * | 4/1994 | Yu et al. | 399/314 |
| 5,370,981 | | 12/1994 | Krafft et al. | 430/529 |
| 5,372,924 | | 12/1994 | Quintens et al. | 430/527 |
| 5,434,657 | * | 7/1995 | Berkes et al. | 399/297 |
| 5,443,944 | | 8/1995 | Krafft et al. | 430/529 |
| 5,629,761 | * | 5/1997 | Theodoulou et al. | 399/307 |
| 5,745,829 | | 4/1998 | Gazit et al. | 399/302 |
| 5,747,412 | | 5/1998 | Leenders et al. | 503/201 |
| 5,750,054 | | 5/1998 | Cinquina et al. | 252/500 |
| 5,766,515 | | 6/1998 | Jonas et al. | 252/500 |
| 5,773,150 | | 6/1998 | Tong et al. | 428/429 |
| 5,792,558 | | 8/1998 | Jonas et al. | 428/419 |
| 5,922,440 | * | 7/1999 | Schlueter, Jr. et al. | 428/195 |
| 5,991,590 | * | 11/1999 | Chang et al. | 399/302 |
| 6,002,907 | * | 12/1999 | Berkes | 399/307 |
| 6,088,565 | * | 7/2000 | Jia et al. | 399/302 |
| 6,141,524 | * | 10/2000 | Berkes et al. | 399/307 |

FOREIGN PATENT DOCUMENTS

| | | |
|---|---|---|
| 56 165173 A | 12/1981 | (JP) . |
| 57 036134 A | 2/1982 | (JP) . |
| 01 267658 A | 10/1989 | (JP) . |
| 10 254249 A | 9/1998 | (JP) . |

* cited by examiner

*Primary Examiner*—Quana M. Grainger
(74) *Attorney, Agent, or Firm*—Annette L. Bade

(57) ABSTRACT

A transfer member having a porous substrate, and a release agent material associated therewith, are discussed.

23 Claims, 5 Drawing Sheets

POROUS TRANSFER MEMBERS AND RELEASE AGENT ASSOCIATED THEREWITH

BACKGROUND OF THE INVENTION

The present invention relates to transfer members useful in electrostatographic reproducing apparatuses, including digital, image on image and contact electrostatic printing apparatuses. The present transfer members can be used as transfer members, transfuse or transfix members, bias transfer members, transport members, and the like. The transfer members are useful, in embodiments, in dry toner or liquid ink development applications and applicable also in aqueous and phase change inkjet applications such as Acoustic Ink Jet Process (AIP). In a preferred embodiment, the transfer members have substrates which comprise porous materials, and a low surface energy release agent such as a silicone release agent is associated with the substrate. In another preferred embodiment, the substrates comprise porous materials which contain fibers.

In a typical electrostatographic reproducing apparatus such as an electrophotographic imaging system using a photoreceptor, a light image of an original to be copied is recorded in the form of an electrostatic latent image upon a photosensitive member and the latent image is subsequently rendered visible by the application of a developer mixture. One type of developer used in such printing machines is a liquid developer comprising a liquid carrier having toner particles dispersed therein. Generally, the toner is made up of resin and a suitable colorant such as a dye or pigment. Conventional charge director compounds may also be present. The liquid developer material is brought into contact with the electrostatic latent image and the colored toner particles are deposited thereon in image configuration.

The developed toner image recorded on the imaging member is transferred to an image receiving substrate such as paper via a transfer member. The toner particles may be transferred by heat and/or pressure to a transfer member, or more commonly, the toner image particles may be electrostatically transferred to the transfer member by means of an electrical potential between the imaging member and the transfer member. After the toner has been transferred to the transfer member, it is then transferred to the image receiving substrate, for example by contacting the substrate with the toner image on the transfer member under heat and/or pressure.

Transfer members enable high throughput at modest process speeds. In four-color photocopier or printer systems, the transfer member also improves registration of the final color toner image. In such systems, the four component colors of cyan, yellow, magenta and black may be synchronously developed onto one or more imaging members and transferred in registration onto a transfer member at a transfer station.

In electrostatographic printing and photocopy machines in which the toner image is transferred from the transfer member to the image receiving substrate, it is desired that the transfer of the toner particles from the transfer member to the image receiving substrate be substantially 100 percent. Less than complete transfer to the image receiving substrate results in image degradation and low resolution. Completely efficient transfer is particularly desirable when the imaging process involves generating full color images since undesirable color deterioration in the final colors can occur when the color images are not completely transferred from the transfer member.

Thus, it is desirable that the transfer member surface has excellent release characteristics with respect to the toner particles. Conventional materials known in the art for use as transfer members often possess the strength, conformability and electrical conductivity necessary for use as transfer members, but can suffer from poor toner release characteristics, especially with respect to higher gloss image receiving substrates.

Although use of a release agent increases toner transfer, the transfer member outer layer tends to swell upon addition of the release agent. For example, it has been shown that silicone rubber performs well as a transfer layer, but swells significantly in the presence of hydrocarbon fluid release agent. Also, release properties have been shown to decay from repeated interaction with certain release agents such as hydrocarbon release agents.

U.S. Pat. No. 5,459,008 discloses an intermediate transfer member in combination with a thin film coating of a release agent material comprising a polyolefin, a silicone polymer, or grafts of these polymers, and mixtures thereof.

A need remains for transfer members that exhibit substantially 100 percent toner transfer, without system failure, to image receiving substrates having glosses ranging from low to very high. Further, a need remains for a combination of transfer member surface layer and release agent that does not result in significant swelling of the outer layer of the transfer member. In addition, it is desired to present a combination of transfer member layer and release agent in which the release properties of the transfer member do not significantly decay over repeated interaction with the release agent. Furthermore, it is desired to provide a less expensive transfer member, and possibly one which is environmentally friendly and may be recycled.

SUMMARY OF THE INVENTION

Embodiments of the present invention include: a transfer member comprising a substrate, wherein said substrate comprises a porous material, and a release agent material coating on said substrate, wherein the release agent material comprises a low surface energy material.

Embodiments further include: an image forming apparatus for forming images on a recording medium comprising: a charge-retentive surface to receive an electrostatic latent image thereon; a development component to apply a developer material to said charge-retentive surface to develop said electrostatic latent image to form a developed image on said charge retentive surface; a transfer component to transfer the developed image from said charge retentive surface to a copy substrate, said transfer member comprising a substrate, wherein said substrate comprises a porous material, and a release agent material coating on said substrate, wherein the release agent material comprises a low surface energy material; and a fixing component to fuse said transferred developed image to said copy substrate.

Embodiments also include: an image forming apparatus for forming images on a recording medium comprising: a charge-retentive surface to receive an electrostatic latent image thereon; a development component to apply a developer material to said charge-retentive surface to develop said electrostatic latent image to form a developed image on said charge retentive surface; and a transfuse component to transfer the developed image from said charge retentive surface to a copy substrate and to fuse said developed image to said copy substrate, said transfuse component comprising a substrate, wherein said substrate comprises a porous material, and a release agent material coating on said substrate, wherein the release agent material comprises a low surface energy material.

BRIEF DESCRIPTION OF THE DRAWINGS

For a better understanding of the present invention, reference may be had to the accompanying figures.

DETAILED DESCRIPTION OF THE PRESENT INVENTION

The present invention relates to transfer and transfix or transfuse members having a release agent in combination therewith, in order to enhance transfer of image, and decrease image transfer decays. The present combination of outer transfer material and release agent also enhances the life of the transfer member, by providing a transfer substrate which is less susceptible to swell.

In an electrostatographic printing and photocopy machine, each image being transferred is formed on an imaging member. The imaging member can take conventional forms such as a photoreceptor belt or drum, an ionographic belt or drum, and the like. The image may then be developed by contacting the latent image with a toner or developer at a developing station. The development system can be either wet or dry. The developed image is then transferred to a transfer member. The image can be either a single image or a multi-image. In a multi-image system, each of the images may be formed on the imaging member and developed sequentially and then transferred to the transfer member, or in an alternative method, each image may be formed on the imaging member, developed, and transferred in registration to the transfer member.

Figure 1:
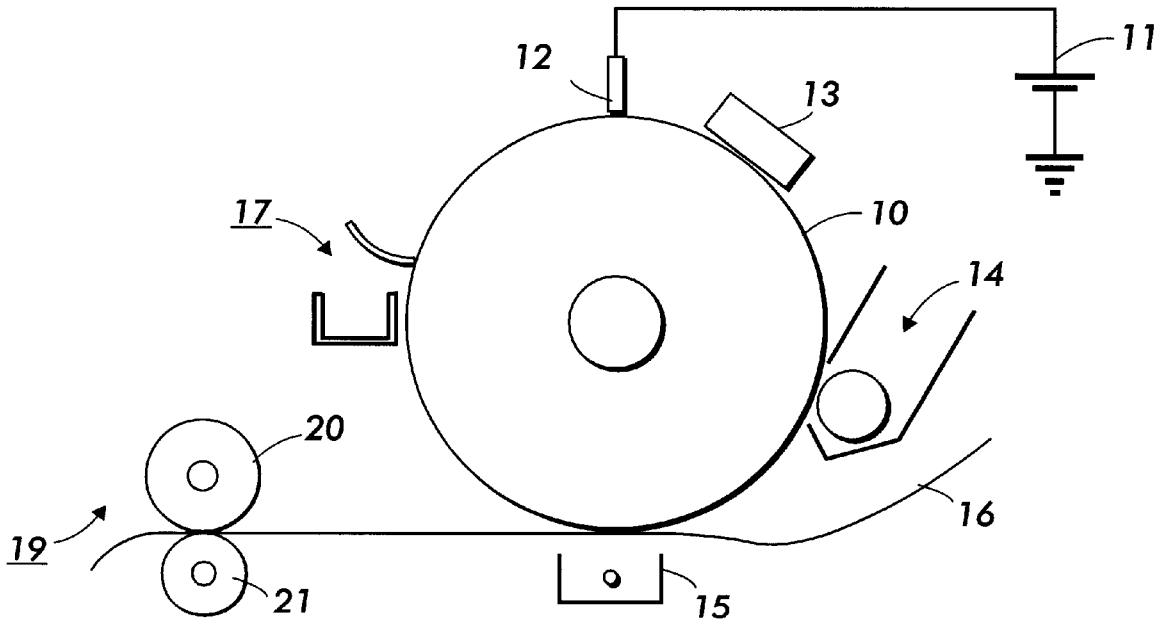
FIG. 1 is a schematic illustration of an image apparatus in accordance with the present invention.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser roll 20 and pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

The transfer members employed for the present invention can be of any suitable configuration. Examples of suitable configurations include a sheet, a film, a web, a foil, a strip, a coil, a cylinder, a drum, an endless mobius strip, a circular disc, a belt including an endless belt, an endless seamed flexible belt, an endless seamless flexible belt, an endless belt having a puzzle cut seam, and the like. Preferably, the substrate is in the form of a sheet, belt, film, web, or the like.

The transfer components of the instant invention may be employed in either an image on image transfer or a tandem transfer of a toned image(s) from is the photoreceptor to the transfer component, or in a transfix system for simultaneous transfer and fusing the transferred and developed latent image to the copy substrate. In an image on image transfer, the color toner images are first deposited on the photoreceptor and all the color toner images are then transferred simultaneously to the transfer component. In a tandem transfer, the toner image is transferred one color at a time from the photoreceptor to the same area of the transfer component.

Transfer of the developed image from the imaging member to the transfer element and transfer of the image from the transfer element to the substrate can be by any suitable technique conventionally used in electrophotography, such as corona transfer, pressure transfer, bias transfer, and the like, or combinations of those transfer means. In the situation of transfer from the transfer medium to the substrate, transfer methods such as adhesive transfer, wherein the receiving substrate has adhesive characteristics with respect to the developer material, can also be employed. Typical corona transfer entails contacting the deposited toner particles with the substrate and applying an electrostatic charge on the surface of the substrate opposite to the toner particles. A single wire corotron having applied thereto a potential of between about 5,000 and about 8,000 volts provides satisfactory transfer. In a specific process, a corona generating device sprays the back side of the image receiving member with ions to charge it to the proper potential so that it is tacked to the member from which the image is to be transferred and the toner powder image is attracted from the image bearing member to the image receiving member. After transfer, a corona generator charges the receiving member to an opposite polarity to detach the receiving member from the member that originally bore the developed image, whereupon the image receiving member is separated from the member that originally bore the image.

For color imaging, typically, four image forming devices are used. The image forming devices may each comprise an image receiving member in the form of a photoreceptor of other image receiving member. The transfer member is of an embodiment of the present invention is supported for movement in an endless path such that incremental portions thereof move past the image forming components for transfer of an image from each of the image receiving members. Each image forming component is positioned adjacent the transfer member for enabling sequential transfer of different color toner images to the transfer member in superimposed registration with one another.

The transfer member moves such that each incremental portion thereof first moves past an image forming component and comes into contact with a developed color image on an image receiving member. A transfer device, which can comprise a corona discharge device, serves to effect transfer of the color component of the image at the area of contact between the receiving member and the transfer member. In a like fashion, image components of colors such as red, blue, brown, green, orange, magenta, cyan, yellow and black, corresponding to the original document also can be formed on the transfer member one color on top of the other to produce a full color image.

A transfer sheet or copy sheet is moved into contact with the toner image on the transfer member. A bias transfer member may be used to provide good contact between the sheet and the toner image at the transfer station. A corona transfer device also can be provided for assisting the bias transfer member in effecting image transfer. These imaging steps can occur simultaneously at different incremental portions of the transfer member. Further details of the transfer method employed herein are set forth in U.S. Pat. No. 5,298,956 to Mammino, the disclosure of which is hereby incorporated by reference in its entirety.

The transfer member herein can be employed in various devices including, but not limited to, devices described in U.S. Pat. Nos. 3,893,761; 4,531,825; 4,684,238; 4,690,539; 5,119,140; and 5,099,286; the disclosure of all of which are hereby incorporated by reference in their entirety.

Figure 2:
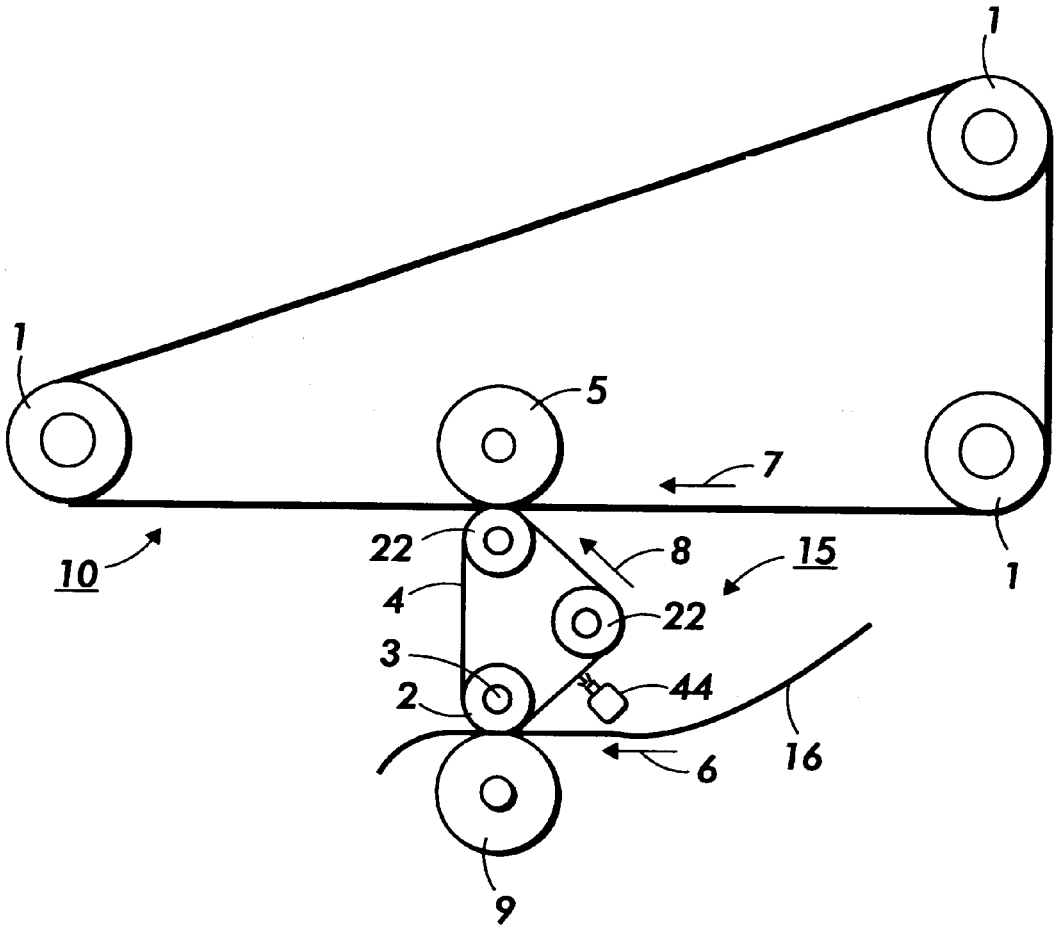
FIG. 2 is an illustration of an embodiment of the present invention, and represents a transfuse member.

Transfer and fusing may occur simultaneously in a transfix configuration. As shown in FIG. 2, a transfer apparatus 15 is depicted as transfix belt 4 being held in position by driver rollers 22 and heated roller 2. Heated roller 2 comprises a heater element 3. Transfix belt 4 is driven by driving rollers 22 in the direction of arrow 8. The developed image from photoreceptor 10 (which is driven in direction 7 by rollers 1) is transferred to transfix belt 4 when contact with photoreceptor 10 and belt 4 occurs. Pressure roller 5 aids in transfer of the developed image from photoreceptor 10 to transfix belt 4. The transferred image is subsequently transferred to copy substrate 16 and simultaneously fixed to copy substrate 16 by passing the copy substrate 16 between belt 4 (containing the developed image) and pressure roller 9. A nip is formed by heated roller 2 with heating element 3 contained therein and pressure roller 9. Copy substrate 16 passes through the nip formed by heated roller 2 and pressure roller 9, and simultaneous transfer and fusing of the developed image to the copy substrate 16 occurs.

Figure 3:
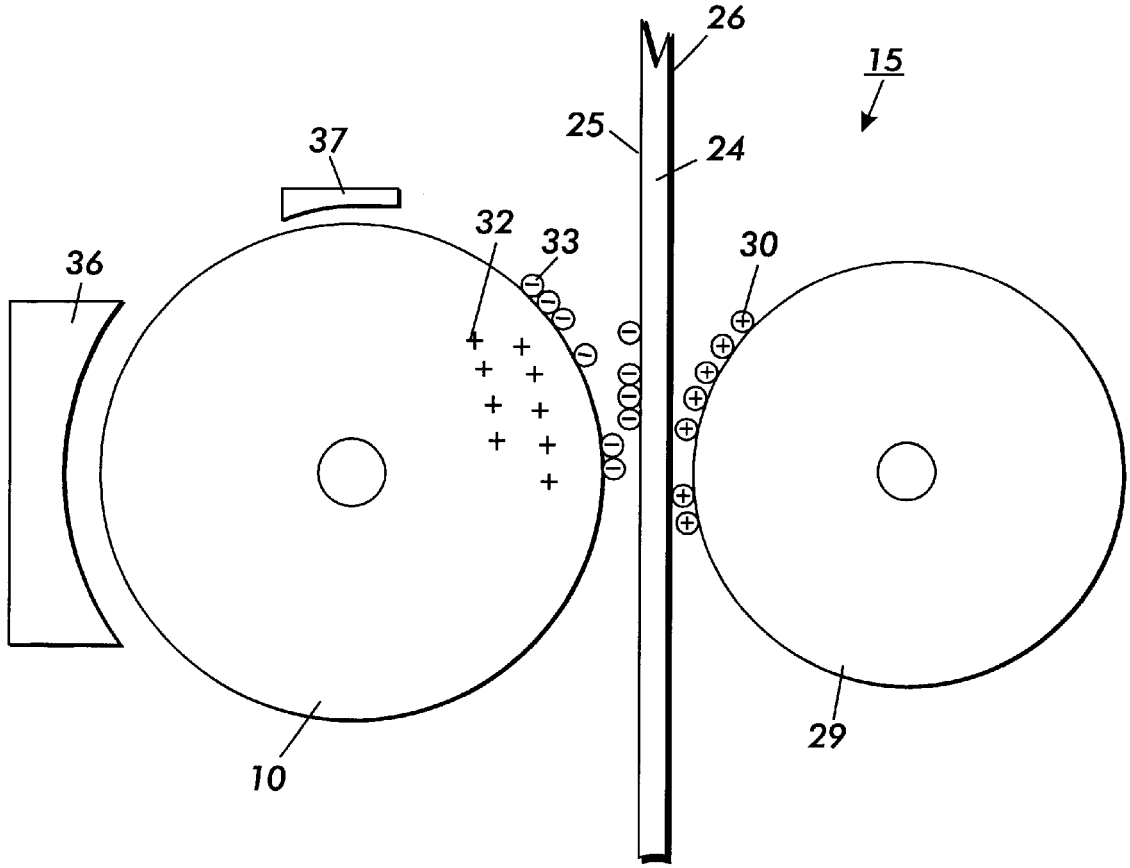
FIG. 3 is a schematic view of an image development system containing an intermediate transfer member.

FIG. 3 demonstrates another embodiment of the present invention and depicts a transfer apparatus 15 comprising a transfer member 24 positioned between an imaging member 10 and a transfer roller 29. The imaging member 10 is exemplified by a photoreceptor drum. However, other appropriate imaging members may include other electrostatographic imaging receptors such as ionographic belts and drums, electrophotographic belts, and the like.

In the multi-imaging system of FIG. 3, each image being transferred is formed on the imaging drum by image forming station 36. Each of these images is then developed at developing station 37 and transferred to transfer member 24. Each of the images may be formed on the photoreceptor drum 10 and developed sequentially and then transferred to the transfer member 24. In an alternative method, each image may be formed on the photoreceptor drum 10, developed, and transferred in registration to the transfer member 24. In a preferred embodiment of the invention, the multi-image system is a color copying system. In this color copying system, each color of an image being copied is formed on the photoreceptor drum. Each color image is developed and transferred to the transfer member 24. As above, each of the colored images may be formed on the drum 10 and developed sequentially and then transferred to the transfer member 24. In the alternative method, each color of an image may be formed on the photoreceptor drum 10, developed, and transferred in registration to the transfer member 24.

After latent image forming station 36 has formed the latent image on the photoreceptor drum 10 and the latent image of the photoreceptor has been developed at developing station 37, the charged toner particles 33 from the developing station 37 are attracted and held by the photoreceptor drum 10 because the photoreceptor drum 10 possesses a charge 32 opposite to that of the toner particles 33. In FIG. 3, the toner particles are shown as negatively charged and the photoreceptor drum 10 is shown as positively charged. These charges can be reversed, depending on the nature of the toner and the machinery being used. In a preferred embodiment, the toner is present in a liquid developer. However, the present invention, in embodiments, is useful for dry development systems also.

A biased transfer roller 29 positioned opposite the photoreceptor drum 10 has a higher voltage than the surface of the photoreceptor drum 10. As shown in FIG. 3, biased transfer roller 29 charges the backside 26 of transfer member 24 with a positive charge. In an alternative embodiment of the invention, a corona or any other charging mechanism may be used to charge the backside 26 of the transfer member 24.

The negatively charged toner particles 33 are attracted to the front side 25 of the transfer member 24 by the positive charge 30 on the backside 26 of the transfer member 24.

The transfer member is preferably in the form of a film, sheet, web or belt as it appears in FIG. 3, or in the form of a roller. In a particularly preferred embodiment of the invention, the transfer member is in the form of a belt. In another embodiment of the invention, not shown in the figures, the transfer member may be in the form of a sheet.

Figure 4:
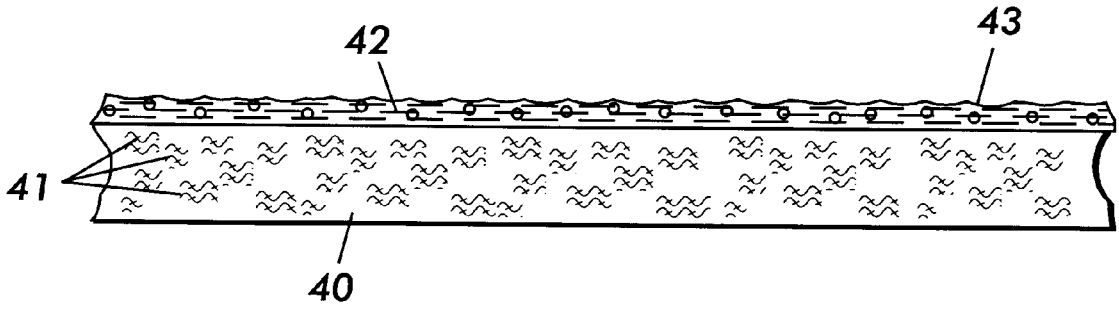
FIG. 4 is an illustration of an embodiment of the invention, demonstrating a substrate having fibers dispersed or contained therein, and an outer release layer.

FIG. 4 demonstrates a preferred configuration of an embodiment of the present invention. Included therein is a transfer or transfuse substrate 40 having fibers 41 dispersed or contained therein, and release agent material layer 42. In a preferred embodiment, the release agent comprises fillers 43.

Transfer member substrates are preferably comprised of a material that has good dimensional stability, is resistant to attack by materials of the toner or developer, is conformable to an image receiving substrate such as paper and is preferably electrically semiconductive. Conventional materials known in the art as useful for transfer member substrates include silicone rubbers, fluorocarbon elastomers such as are available under the trademark VITON® from E. I. du Pont de Nemours & Co., polyvinyl fluoride such as available under the tradename TEDLAR® also available from E. I. du Pont de Nemours & Co, various fluoropolymers such as polytetrafluoroethylene (PTFE), perfluoroalkoxy (PFA-TEFLON®), fluorinated ethylenepropylene copolymer (FEP), other TEFLON®—like materials, and the like, and mixtures thereof.

The transfer member is preferably in the form of a single layer, however, in an optional embodiment, the transfer member material may be coated upon a thermally conductive and electrically semiconductive substrate.

Examples of suitable substrate materials include but are not limited to substrates comprising porous materials, such as foamed materials. Generally, a conductive foam can be prepared by use of known techniques including adding gas or blowing agent to the composition which forms a closed cell foam structure, adding salts to the composition which are later leached away to form an open cell structure, directly introducing a gas into the composition, or by coagulations techniques to produce open cell or closed cell structures depending on the process conditions chosen. These processes are well known and are fully described in the literature, for example, *The Encyclopedia of Chemical Technology,* Third edition, Vol. 11, pp. 82–126. Suitable blowing agents produce gas and generate cells or gas pockets in polymer materials. Blowing agents are well known and, for example, are listed in the *Encyclopedia of Polymer Science and Engineering,* Vol. 2, starting on page 434. Specific examples of physical blowing agents include pentanes, pentenes, hexanes, hexenes, heptanes, heptenes, benzenes, toluenes, methanes, ethanes, alcohols, ketones and the like. Specific examples of chemical blowing agents include sodium bicarbonate, dinitrosopentamethylenetetramine, p-toluenesulfonyl hydrazide, 4,4'-oxybis(benzenesulfonyl hydrazide), azodicarbonamide (1,1'-azobisformamide), p-toluenesulfonyl semicarbazide, 5-phenyltetrazole, 5-phenyltetrazole analogues, diisopropylhydrazodicarboxylate, and 5-phenyl-3,6-dihydro-1,3,4-oxadiazin-2-one. By adding salts to the composition which are later leached away, an open cell structure can be formed. By reducing the soluble salt concentration in the composition, a closed cell product may be formed. Most water soluble salts or compounds (organic and inorganic) may be used as the salt including magnesium sulfate, sodium chloride, sodium nitrate, urea, citric acid, and the like. Coagulation processes in which the polymer solvent is replaced by a non-solvent causing the polymer to precipitate and generate channels or pore sites may also be used to produce a foamed article. These processes are also well known and are described in the literature, for example, *Encyclopedia of Chemical Technology,* Third ed., Vol. 14, p. 231–249.

The foaming technique is used to generate a preferred pore size so as to reduce the occurrence of relatively large amounts of toner becoming trapped inside the pores of the foam. The diameter of toner is generally about 10 microns. Penetration of toner particles into the foam tends to increase the hardness of the foam. It is preferred that the diameter of the pore openings of the foam be at most twice an average diameter of the toner particles, in order to prevent potentially detrimental penetration of the toner particles into the pores. Therefore, the pores of the foam layer preferably have an average diameter of from about 0.1 to about 20 microns, preferably from about 1 to about 15 microns and particularly preferred from about 1 to about 9 microns.

In a preferred embodiment, the substrate is a porous material comprising fibers. Examples of suitable substrates include porous fabric materials such as those disclosed in U.S. patent application Ser. No. 09/050,135, filed Mar. 30, 1998, entitled "Fabric Fuser Film" and the like. Fabrics are materials made from fibers or threads and woven, knitted or pressed into a cloth or felt type structures. Woven, as used herein, refers to closely oriented by warp and filler strands at right angles to each other. Nonwoven, as used herein, refers to randomly integrated fibers or filaments. The fabric material useful as the substrate herein must be suitable for allowing a high operating temperature (i.e., greater than about 180° C., preferably greater than 200° C.), capable of exhibiting high mechanical strength, providing heat insulating properties (this, in turn, improves the thermal efficiency of the proposed fusing system), and possessing electrical insulating properties. In addition, it is preferred that the fabric substrate have a flexural strength of from about 2,000,000 to about 3,000,000 psi, and a flexural modulus of from about 25,000 to about 55,000 psi. Examples of suitable fabrics include woven or nonwoven cotton fabric, graphite fabric, fiberglass, woven or nonwoven polyimide for example KELVAR® available from DuPont), woven or nonwoven polyamide, such as nylon or polyphenylene isophthalamide (for example, NOMEX® of E.I. DuPont of Wilmington, Del.), polyester, polycarbonate, polyacryl, polystyrene, polyethylene, polypropylene such as polypropylene naphthalate, polyphenylene sulfide, and the like.

In an optional preferred embodiment of the invention, the substrate is a paper-type substrate comprising paper-type fibers. It is preferred that the paper-like substrate have a tensile strength greater than 4000 psi, and conductivity ranging from about $10^{-4}$ to about $10^{-14}$ ohms-cm, preferably from about $10^{-8}$ to about $10^{-12}$ ohm-cm. Release paper that has thin silicon coating (referred to as "silicone paper") such as those available from Enterprise Corporation and SilTech are desirable. The fibers in the paper pulp can be of vegetable origin or animal, mineral or synthetics. It is preferred that the paper-like substrates herein be suitable for allowing a high operating temperature (i.e., greater than about 180° C., preferably from about 200 to about 270° C.), capable of exhibiting high mechanical strength, providing heat insulating properties (this, in turn, improves the thermal efficiency of the proposed fusing system), and possessing electrical insulating properties.

In a preferred embodiment, a release agent is used in combination with the transfer member or transfix member. Preferred release agents include low surface energy release agents such as silicones, waxes, fluoropolymers and like materials. Oil or waxed-based release agents tend to cause a silicone rubber outer transfer layer to swell. Therefore, particularly preferred release agents are aqueous silicone polymer release agents such as aqueous polydimethyl siloxane, fluorosilicone, fluoropolymers, and the like. In a particularly preferred embodiment, the release agent is a polydimethyl siloxane release agent that is a liquid emulsion instead of oil-based or wax-based, and comprises cationic electrical control agents or metallic end group polymers to impart cationic electrical conductivity. Examples of commercially available silicone release agents include GE Silicone SM2167 Antistat®, General electric SF1023, DF1040, SF1147, SF1265, SF1706, SF18-350, SF96, SM2013, SM2145, SF1154, SM3030, DF104, SF1921, SF1925, SF69, SM2101, SM2658, SF1173, SF1202 and SF1204.

The release agent material may or may not comprise conductive fillers. Suitable conductive fillers include carbon black or graphite; boron nitride; metal oxides such as copper oxide, zinc oxide, titanium dioxide, silicone dioxide, and like metal oxides; and mixtures thereof. If a filler is present in the release agent material, it is preferably present in an amount of from about 0.5 to about 40 percent, preferably from about 0.5 to about 15 percent by weight of total solids. Total solids as used herein refers to the total amount of solids in the material.

In one embodiment, the release agent can be applied to the transfer member as a relatively thin outer coating layer prior to transfer of the developer material. Preferably, the release agent is applied to the transfer member by a wick, roller, or other known application member. The release agent is supplied in an amount of from about 0.1 to about 15 $\mu$l/copy, preferably from about 0.1 to about 2 $\mu$l/copy, and as a thin film covering the substrate of the transfer member. The thin film of the release agent has a thickness of from about 2 microns to about 125 microns, preferably from about 8 to about 75 microns, and particularly preferred about 12 to about 25 microns.

In a preferred embodiment, the release agent is continuously applied to the transfer member. Different porous materials can be used as the materials for the intermediate transfer, bias transfer or transfuse base material. Foams, paper, porous polymers, and like materials can all be used with different porosity. The more porous the material the more release agent can be absorbed into the fibrous network. The release agent can be absorbed into the porous material and then used as a transfer or transfix material. The release agent can also be applied, in process, by application to the top surface or back side of the transfer or transfix belt. This application can be accomplished through typical application techniques such as roll metering, saturated pads, or other liquid application techniques. In an optional desired embodiment, the release agent is embedded in the substrate fibers. The term "embedded" as used herein, refers to the release agent soaking or spreading into the substrate material and becoming integrally intermixed with the fibers combined in the substrate material.

The volume resistivity of the transfer member is from about $10^4$ to about $10^{14}$ ohms-cm, and preferably from about $10^8$ to about $10^{12}$ ohms-cm.

Preferably, it is desired to presoak a specific substrate with a liquid release agent. For example, in a preferred example, a scroll of paper material with a porosity of from about 1 to about 50 percent can be incorporated with an electrically controlled aqueous silicone release agent. This material is then used as either or in combination with a transfer and transfuse process. The amount of diffusion of the liquid release agent out of the porous paper material is controlled by paper porosity, release agent viscosity and the temperature of the process.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Transfer using Known Intermediate Transfer Member Coating

An intermediate transfer member was coated with a fluoroelastomer coating (VITON® from DuPont) and was used as a transfer member. The transfer member was tested in a photocopy machine. Transfers were tested both with and without the use of release agents. The transfer pressure was 100 pounds. Prior to the tests, the surface of the VITON® substrate was cleaned and wiped dry. Next, an image was screen printed, and heated 5 minutes in a platen at 120° F.–180° F. White copy paper (LX paper) was added, and the platen reheated. The transfer occurred at 100 pound loads and at a speed of approximately 10 in/sec with cold rollers.

The transfer was not successful as the transfer of the image was not complete.

Example 2

Transfer using Known Silicone Paper Intermediate Transfer Member Without Release Agent A silicone paper substrate used as a transfer member was tested in a photocopy machine in accordance with the testing procedure described in is Example 1. Transfers were tested both with and without the use of release agents. The first transfer without any release agent was good.

Example 3

Transfer using Known Silicone Paper Intermediate Transfer Member With Hydrocarbon Release Agent A silicone paper belt was tested in accordance with the procedures set forth in Examples 1 and 2, except for in this example, a hydrocarbon release agent (Isopar G) was used. The release agent was found to attack the paper transfer member. Transfer of a liquid image was not accomplished after the application of the release agent to the porous material.

Example 4

Transfer using Known Silicone Paper Intermediate Transfer Member With Silicone Release Agent A silicone paper belt was tested in accordance with the procedures set forth in Examples 1 and 2. This time, release agent ARA 8001 from Adhesive Research was used. The release agent was absorbed into the porous paper transfer member. Transfer of a liquid image was accomplished after the application of the release agent to the porous material. The transfer was successful and a full image was transferred.

Figure 5:
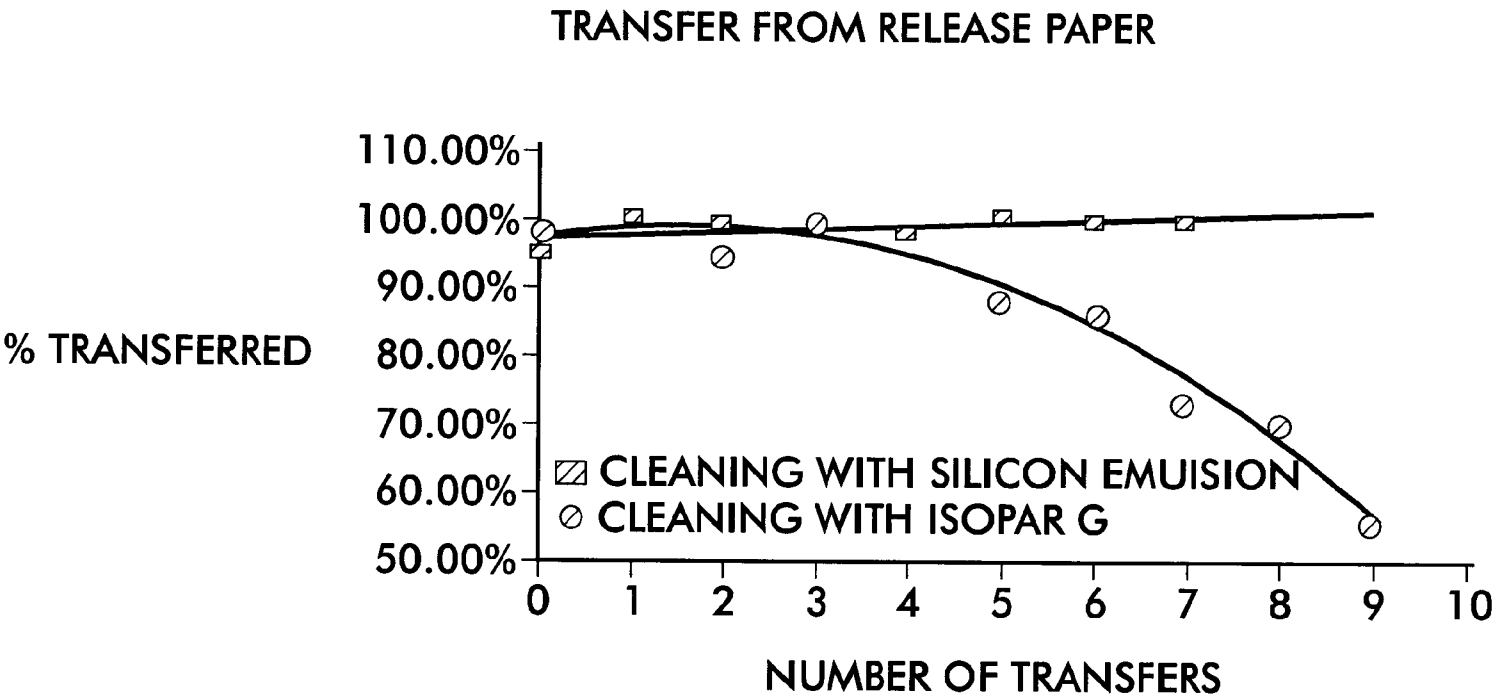
FIG. 5 is a graph of a number of transfers versus percent toner transfer.

The results of the experiments of Examples 3 and 4 are set forth in the Drawings. FIG. 5 is a graph of a number of transfers versus percent toner transfer. FIG. 5 demonstrates that the percentage efficiency of transfer is sufficiently higher with repeated transfers, when a silicone paper belt is used in combination with a silicone release agent as compared to a silicone paper belt used in combination with a hydrocarbon release agent.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A transfer member comprising a substrate, wherein said substrate comprises a porous material, and a liquid release agent material coating on said substrate, wherein the release agent material comprises a low surface energy material comprising polydimethyl siloxane, and wherein a release agent apparatus supplies release agent material to said substrate.

2. A transfer member in accordance with claim 1, wherein said polydimethyl siloxane is cationic.

3. A transfer member in accordance with claim 1, wherein said release agent material further comprises conductive fillers.

4. A transfer member in accordance with claim 3, wherein said conductive filler is selected from the group consisting of carbon black, graphite, metal oxides, and mixtures thereof.

5. A transfer member in accordance with claim 1, wherein said substrate comprises fibers.

6. A transfer member in accordance with claim 5, wherein said substrate comprises said release agent embedded into the fibers of said substrate.

7. A transfer member in accordance with claim 1, wherein said substrate comprises a material selected from the group consisting of silicone paper, polyimide fabric, polyamide fabric, cotton fabric, graphite fabric, silicone elastomers, fiberglass, polyethylenes, polypropylenes, polyesters, polyacryls, and polyphenylenes.

8. A transfer member in accordance with claim 1, wherein said transfer member is in the form of a belt, a web, a film, a roll, or sheet.

9. A transfer member in accordance with claim 1, wherein said substrate comprises a paper-type material having paper-type fibers dispersed therein.

10. An image forming apparatus for forming images on a recording medium comprising:

a charge-retentive surface to receive an electrostatic latent image thereon;

a development component to apply a developer material to said charge-retentive surface to develop said electrostatic latent image to form a developed image on said charge-retentive surface;

a transfer component to transfer the developed image from said charge retentive surface to a copy substrate, said transfer member comprising a substrate, wherein said substrate comprises a porous material, and a liquid release agent material coating on said substrate, wherein the release agent material comprises a low surface energy material comprising polydimethyl siloxane, and wherein a release agent apparatus supplies release agent material to said substrate; and a fixing component to fuse said transferred developed image to said copy substrate.

11. An image forming apparatus in accordance with claim 10, wherein said developer material is a liquid developer comprising toner particles.

12. An image forming apparatus in accordance with claim 10, wherein said polydimethyl siloxane is cationic.

13. An image forming apparatus in accordance with claim 10, wherein said transfer substrate comprises fibers.

14. An imaging forming apparatus in accordance with claim 10, wherein said transfer substrate comprises paper-type material having paper-type fibers disbursed therein.

15. An image forming apparatus in accordance with claim 10, wherein said transfer substrate comprises a material selected from the group consisting of silicone paper, polyimide fabric, polyamide fabric, cotton fabric, graphite fabric, silicone elastomers, fiberglass, polyethylenes, polypropylenes, polyesters, polyacryls, and polyphenylenes.

16. An image forming apparatus in accordance with claim 10, wherein said transfer substrate comprises said release agent embedded into the fibers of said transfer substrate.

17. An image forming apparatus for forming images on a recording medium comprising:

a charge-retentive surface to receive an electrostatic latent image thereon;

a development component to apply a developer material to said charge-retentive surface to develop said electrostatic latent image to form a developed image on said charge-retentive surface; and a transfuse component to transfer the developed image from said charge retentive surface to a copy substrate and to fuse said developed image to said copy substrate, said transfuse component comprising a substrate, wherein said substrate comprises a porous material, and a liquid release agent material coating on said substrate, wherein the release agent material comprises a low surface energy material comprising polydimethyl siloxane, and wherein a release agent apparatus supplies release agent material to said substrate.

18. An image forming apparatus in accordance with claim 17, wherein said developer material is a liquid developer comprising toner particles.

19. An image forming apparatus in accordance with claim 17, wherein said polydimethyl siloxane is cationic.

20. An image forming apparatus in accordance with claim 17, wherein said transfuse substrate comprises fibers.

21. An image forming apparatus in accordance with claim 17, wherein said transfuse substrate comprises paper-type material having paper-type fibers dispersed therein.

22. An image forming apparatus in accordance with claim 17, wherein said transfuse substrate comprises a material selected from the group consisting of silicone paper, polyimide fabric, polyamide fabric, cotton fabric, graphite fabric, silicone elastomers, fiberglass, polyethylenes, polypropylenes, polyesters, polyacryls, and polyphenylenes.

23. An image forming apparatus in accordance with claim 17, wherein said transfuse substrate comprises said release agent embedded into the fibers of said transfuse substrate.

* * * * *